US006450764B1

(12) United States Patent
Danielsson et al.

(10) Patent No.: US 6,450,764 B1
(45) Date of Patent: Sep. 17, 2002

(54) PULP PUMP

(75) Inventors: Peter Danielsson, Fagervik; Kjell Forslund, Sundsbruk, both of (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/719,715

(22) PCT Filed: Jun. 10, 1999

(86) PCT No.: PCT/SE99/01002

§ 371 (c)(1),
(2), (4) Date: Dec. 15, 2000

(87) PCT Pub. No.: WO99/66209

PCT Pub. Date: Dec. 23, 1999

(30) Foreign Application Priority Data

Jun. 17, 1998 (SE) ..... 9802178

(51) Int. Cl.[7] ..... F01D 25/32
(52) U.S. Cl. ..... 415/169.1; 415/143
(58) Field of Search ..... 415/169.1, 143, 415/169.2, 169.3, 131; 416/223 B; 417/53, 202, 69

(56) References Cited

U.S. PATENT DOCUMENTS 3,644,061 A * 2/1972 McFarlin ..... 415/169.1
4,776,758 A * 10/1988 Gullichsen ..... 415/169.1
4,981,413 A * 1/1991 Elonen et al. ..... 416/169.1
5,116,198 A * 5/1992 Vesala et al. ..... 415/143
5,167,678 A * 12/1992 Elonen et al. ..... 415/169.1
5,324,166 A * 6/1994 Elonen et al. ..... 415/169.1

FOREIGN PATENT DOCUMENTS

EP 0 474 478 A2 3/1992
EP 0 481 598 A2 4/1992
WO WO 92/11458 * 7/1992

* cited by examiner

*Primary Examiner*—Edward K. Look
*Assistant Examiner*—Richard Woo
(74) *Attorney, Agent, or Firm*—Lerner, David, Littenberg, Krumholz & Mentlik, LLP

(57) ABSTRACT

Apparatus is disclosed for pumping a pulp suspension including a housing and an impeller including a central hub, a wheel disk surrounding the central hub, and pump blades extending radially from the central hub along the wheel disk, which includes at least one opening for discharge of an entrained gas from the pump suspension, a vacuum pump at the rear face of the impeller, and vacuum pump blades mounted for rotation within the vacuum pump housing, which includes an outer wall which is eccentrically disposed with respect to the vacuum pump blade, and a rear wall which includes a suction port for receiving the entrained gas, and with the vacuum pump housing mounted adjacent to the central hub to provide a gap therebetween, so that vacuum pump housing is axially adjustable so that the gap can be altered by axial adjustment of the vacuum pump housing.

3 Claims, 1 Drawing Sheet

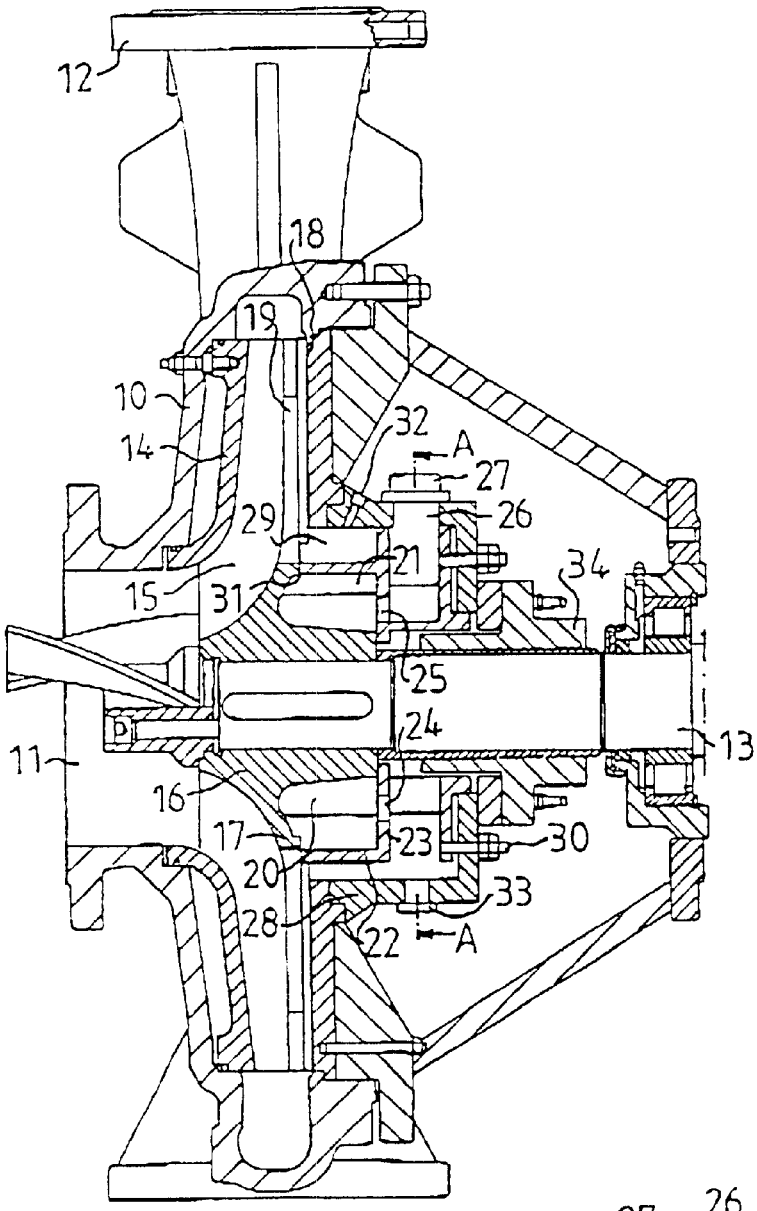
FIG.1
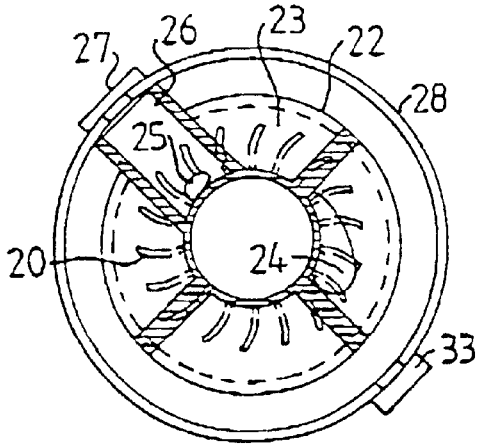
A–A FIG.2

PULP PUMP

BACKGROUND OF THE INVENTION

The present invention relates to a centrifugal pump for pulp suspensions of lignocellulosic material. More particularly, the present invention relates to a pump where gas, such as air, can be separated from the pulp in the pump.

The presence of gas, which follows along with the pulp, causes problems during pumping by centrifugal pumps. The gas in the pulp forms into bubbles, which accumulate in front of the impeller and thereby deteriorate the capacity of the pump. This problem can be remedied by evacuating the gas from the space in front of the impeller, for example by means of vacuum pumps of the liquid ring type. The pumps are often a separate vacuum pump, the suction pipe of which is connected to the sealing space of the pulp pump. They can also be designed as a separate vacuum impeller in the form of a liquid ring impeller located on the shaft of the pulp pump so that a common drive for both impellers is obtained.

In those cases when a separate vacuum pump is used, the pulp pump becomes relatively complicated and expensive, because more components are required in the system. When a separate liquid ring impeller of a conventional type is placed on the same shaft as the pulp pump, the capacity of the liquid ring impeller is restricted for space reasons.

SUMMARY OF THE INVENTION

In accordance with the present invention, these and other problems in the prior art have been eliminated by the discovery of apparatus for pumping a pulp suspension including entrained gas comprising a housing including an inlet for the pulp suspension and an outlet for the pulp suspension, a rotary shaft, an impeller mounted for rotation on the rotary shaft within the housing, the impeller having a front face and a rear face and including a central hub, a wheel disk surrounding the central hub, a plurality of pump blades extending radially from the central hub along the wheel disk, the wheel disk including at least one opening for the discharge of the entrained gas therethrough, a vacuum pump disposed at the rear face of the impeller, the vacuum pump including a vacuum pump housing, a plurality of vacuum pump blades mounted for rotation within the vacuum pump housing, the vacuum pump housing including an outer wall eccentrically disposed with respect to the plurality of vacuum pump blades and a rear vacuum pump wall including a suction port for receiving the entrained gas, the vacuum pump housing being mounted adjacent to the central hub to provide a gap therebetween, an exhaust port for exhausting the exhaust gas therefrom, the vacuum pump housing being axially adjustably mounted whereby the gap between the central hub and the vacuum pump housing can be altered by axial adjustment of the vacuum pump housing, a gas passage disposed radially outside the outer wall of the vacuum pump housing for connecting the at least one opening in the wheel disk with the suction port, and a gas evacuation chamber connected to the exhaust port for evacuation of the entrained gas therefrom. In accordance with a preferred embodiment of the apparatus of the present invention, the apparatus includes a liquid inlet connected to the gas passage for the supply of liquid thereto.

In accordance with another embodiment of the apparatus of the present invention, the apparatus includes a passageway disposed outside the outer wall of the vacuum pump housing for connection of a separate vacuum pump to the gas passage.

The present invention suggests that these problems can be eliminated by the fact that the vacuum impeller is designed to be integrated into the impeller of the pulp pump. The construction is compact and simple, and the capacity of the vacuum pump can be easily controlled. Moreover, the arrangement is formed so that it can easily be combined with a separate vacuum pump so that both pumps can be used in parallel. Alternatively, the separate vacuum pump can be connected at an operation drop-out of the integrated vacuum pump according to the present invention in order thereby to ensure the accessibility for the centrifugal pump.

BRIEF DESCRIPTION OF THE DRAWINGS

The present invention is described in greater detail in the following detailed description, with reference to the accompanying Figures illustrating an embodiment of the present invention, in which:

FIG. 1 is a side, elevational, sectional view of a centrifugal pump according to the present invention; and FIG. 2 is a front, elevational, sectional view, taken along line A—A in FIG. 1.

DETAILED DESCRIPTION

Referring to the Figures, the centrifugal pump shown in FIG. 1 comprises a pump housing 10 with an inlet 11 and an outlet 12 for the pulp suspension. Such pumps are used at relatively high pulp concentrations, for example from about 8 to 12%. On a rotary shaft 13 in the pump housing 10 an impeller 14 with pump blades 15 is located, which pump blades 15 extend from a hub 16 outward along a wheel disk 17. On the rear side of the wheel disk 17 rear blades 18 are located. The wheel disk 17 is formed with openings 19 for the discharge of gas collected in front of the impeller. The openings are preferably designed as slits extending from the hub 16 outward.

Behind the wheel disk 17 the hub 16 is provided with vacuum pump blades 20, which are surrounded by a vacuum pump housing 21. The vacuum pump housing 21 comprises a cylindrical outer wall 22 and a rear wall 23. The cylindrical wall 22 is eccentric in relation to the vacuum pump blades 20 so that a liquid ring pump is formed. In the rear wall 23 a suction port 24 and an exhaust port 25 for gas are, respectively, located. The ports, 24 and 25, are spaced from each other in the circumferential direction, counted for gas suction into the vacuum pump housing and gas exhaust out of the vacuum pump housing, respectively. This effect is brought about by the rotation of the vacuum pump blades and the variations in volume in the circumferential direction of the vacuum pump housing as a consequence of the eccentric location of the wall 22. The exhaust port 25 communicates with a chamber 26 behind the rear wall 23 for gas evacuation through a gas outlet 27. In a sealing housing 28 in the pump housing 10 outside the outer wall 22 a gas passage 29 is located for communication between the openings 19 in the wheel disk 17 and suction port 24.

The vacuum pump housing 21 is axially adjustable in the sealing housing 28 by an adjustment means 30 for setting a gap 31 between the hub 16 of the wheel disk and the outer wall 22.

An inlet 32 for liquid is connected to the sealing housing 28 for the supply of liquid in the gas passage 29. The liquid thus supplied is utilized both as drive liquid for the liquid ring in the vacuum pump as well as flush liquid in the passage 29 and in the sealing housing 28 for external flushing of the shaft sealing 34.

An additional connection opening 33 in the sealing housing 28 to the gas passage 29 can preferably be provided for rendering it possible to connect a separate vacuum pump (not shown).

During the pumping of a pulp suspension from the inlet 11 to the outlet 12 gas enclosed in the pulp will be collected in front of the impeller 14. The vacuum pump integrated in the hub 16 will then suck in the gas through the openings 19 in the wheel disk 17 and from there through the gas passage 29 into the vacuum pump through the suction port 24. By the pumping effect brought about by the vacuum pump blades 20 together with the rotating liquid ring in the vacuum pump housing 21 eccentric with respect to the hub 16, the gas is pumped through the exhaust port 25 and evacuated through the gas outlet 27.

By adjusting the gap 31 the capacity of the vacuum pump can be controlled. By increasing the gap width the liquid leakage through the gap will increase, whereby the capacity of the vacuum pump is reduced, and vice versa.

In the case when a separate vacuum pump is connected to the connection 33, this vacuum pump can serve in parallel with the integrated vacuum pump according to the present invention or be connected at an operational drop-out of the integrated vacuum pump. The operation of the centrifugal pump is thereby ensured.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for pumping a pulp suspension including entrained gas comprising a housing including an inlet for said pulp suspension and an outlet for said pulp suspension, a rotary shaft, an impeller mounted for rotation on said rotary shaft within said housing, said impeller having a front face and a rear face and including a central hub, a wheel disk surrounding said central hub, a plurality of pump blades extending radially from said central hub along said wheel disk, said wheel disk including at least one opening for the discharge of said entrained gas therethrough, a vacuum pump disposed at said rear face of said impeller, said vacuum pump including a vacuum pump housing, a plurality of vacuum pump blades mounted for rotation within said vacuum pump housing, said vacuum pump housing including an outer wall eccentrically disposed with respect to said plurality of vacuum pump blades and a rear vacuum pump wall including a suction port for receiving said entrained gas, said vacuum pump housing being mounted adjacent to said central hub to provide a gap therebetween, an exhaust port for exhausting said exhaust gas therefrom, said vacuum pump housing being axially adjustably mounted whereby said gap between said central hub and said vacuum pump housing can be altered by axial adjustment of said vacuum pump housing, a gas passage disposed radially outside said outer wall of said vacuum pump housing for connecting said at least one opening in said wheel disk with said suction port, and a gas evacuation chamber connected to said exhaust port for evacuation of said entrained gas therefrom.

2. The apparatus of claim 1 including a liquid inlet connected to said gas passage for the supply of liquid thereto.

3. The apparatus of claim 1 including a passageway disposed outside said outer wall of said vacuum pump housing for connection of a separate vacuum pump to said gas passage.

* * * * *

UNITED STATES PATENT AND TRADEMARK OFFICE

CERTIFICATE OF CORRECTION

PATENT NO. : 6,450,764 B1 
DATED : September 17, 2002
INVENTOR(S) : Kjell Forslund and Peter Danielsson It is certified that error appears in the above-identified patent and that said Letters Patent is hereby corrected as shown below:

Column 4,
Lines 20-21, delete "said gap between said central hub and said vacuum pump housing can be altered by".
Line 22, after "housing" insert -- alters the size of said gap between said central hub and said vacuum pump --.

Signed and Sealed this

Seventh Day of January, 2003

JAMES E. ROGAN
*Director of the United States Patent and Trademark Office*